US005431247A

United States Patent [19]

Kishi

[11] Patent Number: 5,431,247

[45] Date of Patent: Jul. 11, 1995

[54] LIFTING APPARATUS

[75] Inventor: Mitsuhiro Kishi, Ashikaga, Japan

[73] Assignee: Japanic Corporation, Tochigi, Japan

[21] Appl. No.: 220,714

[22] Filed: Mar. 31, 1994

[30] Foreign Application Priority Data

Apr. 9, 1993 [JP] Japan ..... 5-107718

[51] Int. Cl.[6] ..... B66F 11/04

[52] U.S. Cl. ..... 182/63; 182/141

[58] Field of Search ..... 182/63, 141, 148, 2; 187/18

[56] References Cited

U.S. PATENT DOCUMENTS

| | | | |
|---|---|---|---|
| 3,619,007 | 11/1971 | Phillips . | |
| 3,664,459 | 5/1972 | Stephens | 182/141 |
| 3,820,631 | 6/1974 | King et al. . | |
| 4,466,509 | 8/1984 | Kishi . | |
| 4,518,061 | 5/1985 | Wehmeyer et al. . | |
| 4,890,692 | 1/1990 | Oakman | 182/141 |
| 5,099,950 | 3/1992 | Kishi . | |

FOREIGN PATENT DOCUMENTS

| | | |
|---|---|---|
| 52-18492 | 4/1977 | Japan . |
| 53-119556 | 10/1978 | Japan . |
| 58-2197 | 1/1983 | Japan . |
| 58-2198 | 1/1983 | Japan . |
| 58-36900 | 3/1983 | Japan . |
| 58-95100 | 6/1983 | Japan . |
| 59-118698 | 7/1984 | Japan . |
| 60-118599 | 6/1985 | Japan . |
| 60-128197 | 7/1985 | Japan . |

*Primary Examiner*—Alvin C. Chin-Shue

*Attorney, Agent, or Firm*—Flynn, Thiel, Boutell & Tanis

[57] ABSTRACT

A lifting apparatus capable of lifting operators or materials upward and capable of lifting a platform on which heavy materials are placed to an elevated spot. The lifting apparatus comprises a pair of middle booms which are rotatably coupled to each other at the center thereof in an X-shape, a lower boom which is extended from or contracted in the middle boom and is connected to a chassis, an upper boom which is extended from and contracted in the middle boom and is connected to the platform, and an operating mechanism which is disposed between the chassis and the middle booms and is movable from a folded position into a vertically straight position for lifting the middle booms.

11 Claims, 15 Drawing Sheets

LIFTING APPARATUS

BACKGROUND OF THE INVENTION

1. Field of the Invention

The present invention relates to a lifting apparatus for use in lifting operators or materials upward for operation at the elevated spot or loading and unloading disused building materials at the building work site, and particularly to a lifting apparatus capable of lifting a platform on which heavy materials are placed to an elevated spot.

2. Prior Art

There has been employed a lifting apparatus for assembling, painting, repairing a highway, a building such as a high-rise building, and the like at an elevated spot, which apparatus is capable of lifting or lowering for loading operations or building materials and the like thereon or unloading the disused materials therefrom so that various operations at the elevated spot can be smoothly performed.

This lifting apparatus has been widely used for repairing a signal mechanism, lifting equipment, etc. at the elevated spot. In the conventional building, for repairing operations and the like at the elevated spot, a scaffold has been set up at a place close to the building wherein the operator climbs up to and down from the elevated spot along the scaffold. In the operations at the elevated spot using the scaffold, the scaffold needs to be assembled and removed, which does not make the operations quick, and creates a burden to the operator when he climbs up to and down from the elevated spot.

To solve the problem, there is proposed a lifting apparatus having a platform which is moved up and down using hydraulic pressure so as to lift or lower operators or building materials. Such a lifting apparatus dispenses with an additional work involved in assembling and removing the scaffold, which expedites the operation. Furthermore, since the operators and the building materials are moved by lifting and lowering the platform using hydraulic pressure, etc. the burden on the operator is reduced, whereby this lifting apparatus has been widely used in modern buildings.

There has been employed a pantograph type telescopic mechanism, i.e. a scissors type comprising a first pair of arms pivotally connected with each other at a central portion thereof and plural pairs of arms connected with the first pair of arms. In this apparatus, it was necessary to lengthen the length of the pairs or increase the number of arms to be connected with one another for increasing the maximum height of the apparatus. Hence, if an apparatus capable of lifting upward as high as possible is designed, it was necessary to assemble a plurality of paired pantographs vertically, which entails increasing the height of the apparatus when folded whereby it is more troublesome for an operator to get thereon or therefrom or to move materials thereon or therefrom.

There have been various proposed arrangements to solve the problems set forth above, for example the one disclosed in U.S. Pat. No. 3,820,631. In a mechanism as proposed by this patent, a lower boom and an upper boom are respectively capable of moving straight into a middle boom, the lower boom is pivotally mounted on a chassis at the end thereof, the upper boom is pivotally mounted on a platform at the end thereof, and these booms are assembled to form an X-shape. In this mechanism, inasmuch as the length of the boom per se becomes long, the height of the platform when folded can be decreased and the platform can be raised to the elevated spot.

However, in this known mechanism, inasmuch as the mechanism for extending the lower boom and upper boom from the middle boom comprises a screw and a thread for engaging with this screw, the telescopic moving speed of the lower and upper booms relative to the middle boom is slow, and hence the platform cannot be moved quickly. Furthermore, since the sliding motion of the lower boom and the upper boom is made by a bevel gear provided at the central portion of the middle boom, the entire length of the combination of the lower boom and the upper boom extending from the middle boom reaches a length only half as long as the middle boom, and hence the mechanism has such a structure that the platform cannot be raised as high as possible.

There has also been proposed a mechanism wherein another boom is inserted into a boom to extend the length thereof so that the entire length thereof is lengthened. For example, in FIG. 4 of Japanese Patent Laid-Open Publication No. 53-119556, lower and upper booms respectively having small diameters are inserted into a middle boom having a large diameter so that the lower and upper booms inserted into the middle boom are pulled out to lengthen the entire length of the booms, whereby the platform is raised high.

However, in this latter mechanism, there is no mechanism for synchronizing the amount of extension and contraction of the lower boom pulled out from the middle boom with that of the upper boom as also pulled out from the middle boom. The lower and the upper booms move individually relative to the middle boom. The amount of extension and contraction is restricted by a link mechanism comprising bars, and hence the complete synchronization of the lower and upper booms relative to the middle boom cannot be achieved. Accordingly, the lower and upper booms cannot be connected to the platform by a pin and the like and non-synchronized error of the amount of the extension and contraction between the lower and upper booms relative to the middle boom can be absorbed by rollers contacting the chassis and the platform. Hence, the platform is liable to swing because of accumulation of jolt caused by many supporting fulcrums and reception of the rolling motion by the roller. As a result, the mechanism is liable to swing due to wind and the like and is unstable, thereby causing the operator to feel anxious.

In FIG. 8 of aforesaid Japanese Patent Laid-Open Publication No. 53-19556, the middle boom which is X-shaped is turned by externally attached hydraulic cylinder wherein the lower and upper booms are pulled out from the middle boom. The amount of extension of the upper and lower booms is restricted by a link mechanism. Accordingly, hydraulic operating force of the hydraulic cylinder acts directly to the upper and lower booms, whereby the length of the upper and lower booms does not reach as long as the entire length of the middle boom when a cylinder rod of the hydraulic cylinder is pulled out at its maximum. Accordingly, it was impossible to cause the maximum length of the entire boom assembly to be extended as long as possible.

There is proposed a structure for extending the entire length of the booms from the folded state in the longitudinal direction thereof as disclosed in, for example, Japanese Patent Application No. 52-18492.

In this arrangement, an outrigger box is fixed to a part of a chassis in parallel with the chassis, wherein the outrigger box is partitioned by partition walls to form accommodating rooms in which outrigger beams are slidably inserted and in one of which an operating cylinder is accommodated. Both outrigger beams are connected to each other by a rope. In this structure, outrigger beams are pulled out from or pulled into the outrigger boxes, whereby both outrigger beams are moved in opposite directions. The length of each outrigger beam to be pulled out and extended from the outrigger box reaches a length substantially the same length as long as the outrigger box. This structure is effective to pull out the outrigger beam as long as possible from the outrigger box. This arrangement merely discloses the structure for the outriggers for fixing the chassis on the ground by floating thereof but it does not lift or lower the platform vertically even if it is applied to the lifting apparatus to be used in the elevated spot. Furthermore, in the drawings of this application, both ends of the outrigger beams are not connected to any building but merely extend and contract freely left and right in horizontal direction.

In view of the problems of the aforementioned application, there are proposed many lifting mechanisms each having an arm and a plurality of booms which are telescopically inserted into the arm so that one arm can be extended in its longitudinal direction. These are, for example, disclosed in Japanese Application No. 56-134487 and No. 56-191065 (now Laid-Open Publication No. 58-36900 and No. 58-95100).

In these proposed lifting mechanisms, three-stage booms are extended in their longitudinal directions wherein middle booms which are connected to each other at the central portion thereof by a shaft in an X-shape are turned relative to each other so that the chassis and the platform are X-shaped as viewed from the side of the lifting mechanism. In the arrangement of these lifting mechanisms, the lower and upper booms extend to reach a length substantially the same length as long as the middle boom so that the platform can be raised to the elevated spot. Since tip ends of the lower and upper booms are respectively connected to the chassis and the platform by pins, the platform has little jolt and it can be maintained strong against swinging motion.

In the lifting mechanisms using such a plurality of extendible boom assemblies which can be extended and contracted in a plurality of stages, there is provided an arrangement in which the lifting mechanism can be extended by raising the middle boom per se by a hydraulic cylinder interposed between the chassis and the center of the middle boom or pushing out the lower boom or the upper boom from the middle boom by the hydraulic cylinder inserted into the middle boom in order to extend the lower and upper booms from the middle boom or contract the lower and upper booms in the middle boom. In such a new proposed lifting apparatus, there are great advantages in that the lower and upper booms are respectively extended from or retracted into the middle boom at the both ends thereof and a pair of middle booms which are assembled at the central portion thereof are turned in the X-shape so that the platform can be lifted stably.

However, in this arrangement, the hydraulic cylinder has to be used for raising the middle booms or extending the lower and upper booms from the middle booms and the distance of the middle booms to be raised is determined by the amount of extension of the hydraulic cylinder. Accordingly, there is proposed an arrangement wherein the amount of extension of the hydraulic cylinder is doubled by a wire or chain, which increase the entire amount of extension of the upper and lower boom from the middle boom. In this arrangement, although the amount of extension can be increased by the combination of the wires or chains, the load or materials to be applied to the platform are supported by the wire or chain. As a result, the loading of the materials on the platform is concentrated on the wire or chain. Accordingly, when the materials on the platform are heavy, a large load is applied to the wire or chain when the platform is lifted. There is thus a drawback in this arrangement in that the load to be lifted by the platform cannot be increased even if the platform can be lifted high because of the load limitations imposed by the wire.

An arrangement of the type briefly described above is shown in U.S. Pat. No. 5,099,950.

In the structure of the mechanism for vertically moving the platform by the telescopic boom assembly which is assembled in the X-shape, there are advantages in that swing or jolt of the platform is less likely to occur, and the number of the booms to be used is small so that the platform can be raised stably, but a disadvantage in that the height of the platform to be raised is determined by the amount of extension of the hydraulic cylinder. In the double speed mechanism using the wire or chain, there are contrary disadvantages in that the amount of extension of the platform can be increased but the load or materials to be raised by the platform cannot be increased. Accordingly, there is desired a lifting mechanism having different performances so that the platform can be raised to the elevated spot using a hydraulic cylinder while carrying heavy materials thereon.

SUMMARY OF THE INVENTION

The present invention provides a lifting apparatus comprising at least one set of paired stretchable boom assemblies each comprising a pair of middle booms which are joined in a generally X-shape for relative pivoting about the central portions thereof, at least one set of lower booms movably telescopically inserted into the middle booms along the longitudinal direction thereof from lower end openings of the middle booms and pivotally connected to a chassis at lower ends thereof with intervals therebetween, at least one set of upper booms telescopically inserted into the middle booms along the longitudinal direction thereof from upper end openings of the middle booms and pivotally connected at upper ends thereof to a platform with intervals therebetween, wherein lower booms and upper booms are respectively slidable synchronous with one another relative to the middle booms to thereby lift or lower the platform while keeping said platform horizontal relative to the ground when the middle booms are moved up and down, characterized in that the lifting apparatus further comprises an operating mechanism which is disposed between the chassis and the middle booms and which is folded and is assembled vertically straight for lifting the middle booms.

According to the present invention, the platform is first raised by a kick mechanism and the operating mechanism which is folded in a substantially C-shape is assembled straight to thereby extend upward so that the platform can be raised. Accordingly, the platform is always operated by the vertical moving force of the kick mechanism and the operating mechanism in the vertical direction and it receives directly the extension force of the hydraulic cylinder so that the platform can raise the heavy materials. Since the operating mechanism comprises the combination of the hydraulic cylinders and the hydraulic cylinders serve as the hydraulic cylinder to extend upward, the amount of extension is increased compared with the conventional hydraulic cylinder, which can elevate the platform at the elevated spot while dispensing with the double speed mechanism composed of the wire or chain.

The above and other objects, features and advantages of the present invention will become apparent from the following description taken in conjunction with the accompanying drawings.

DETAILED DESCRIPTION

Figure 1:
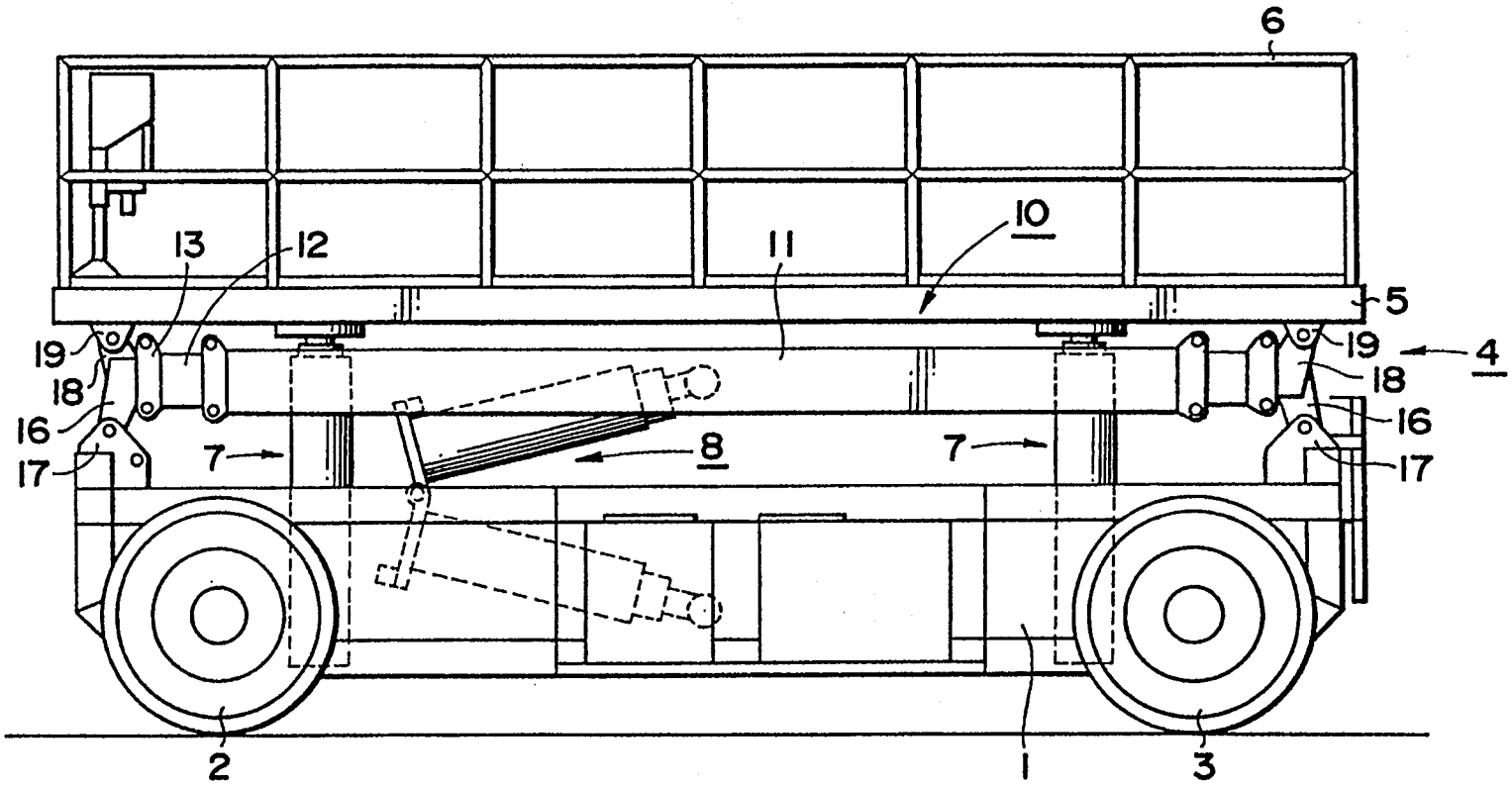
FIG. 1 is a side view of a lifting apparatus according to a preferred embodiment of the present invention in which a platform is in its lowest position.
Figure 2:
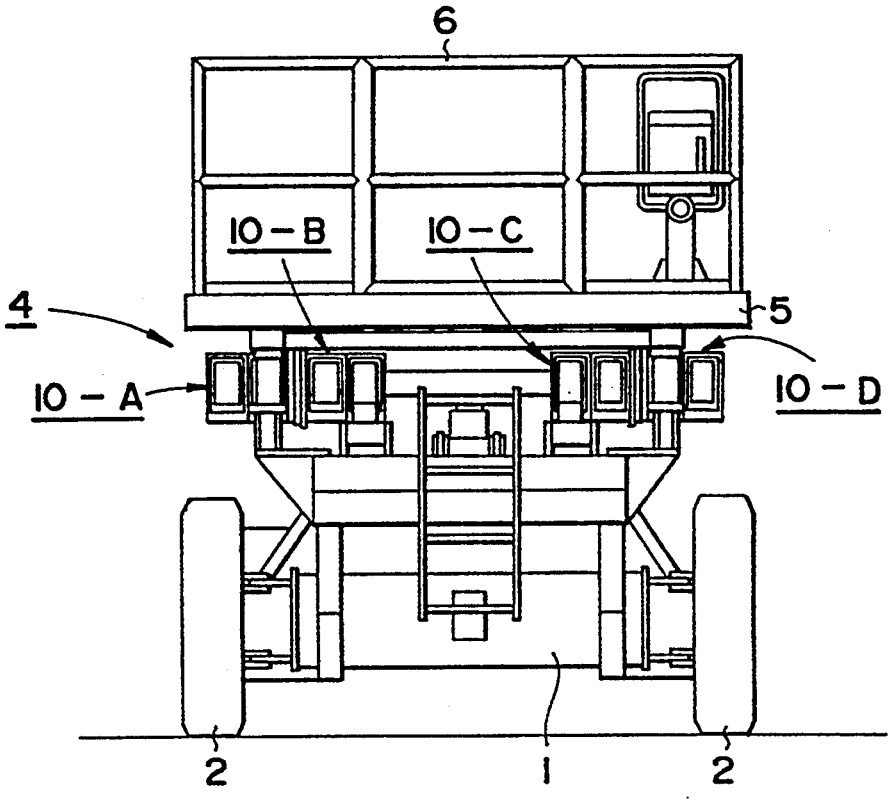
FIG. 2 is a front view of the lifting apparatus in FIG. 1.
Figure 3:
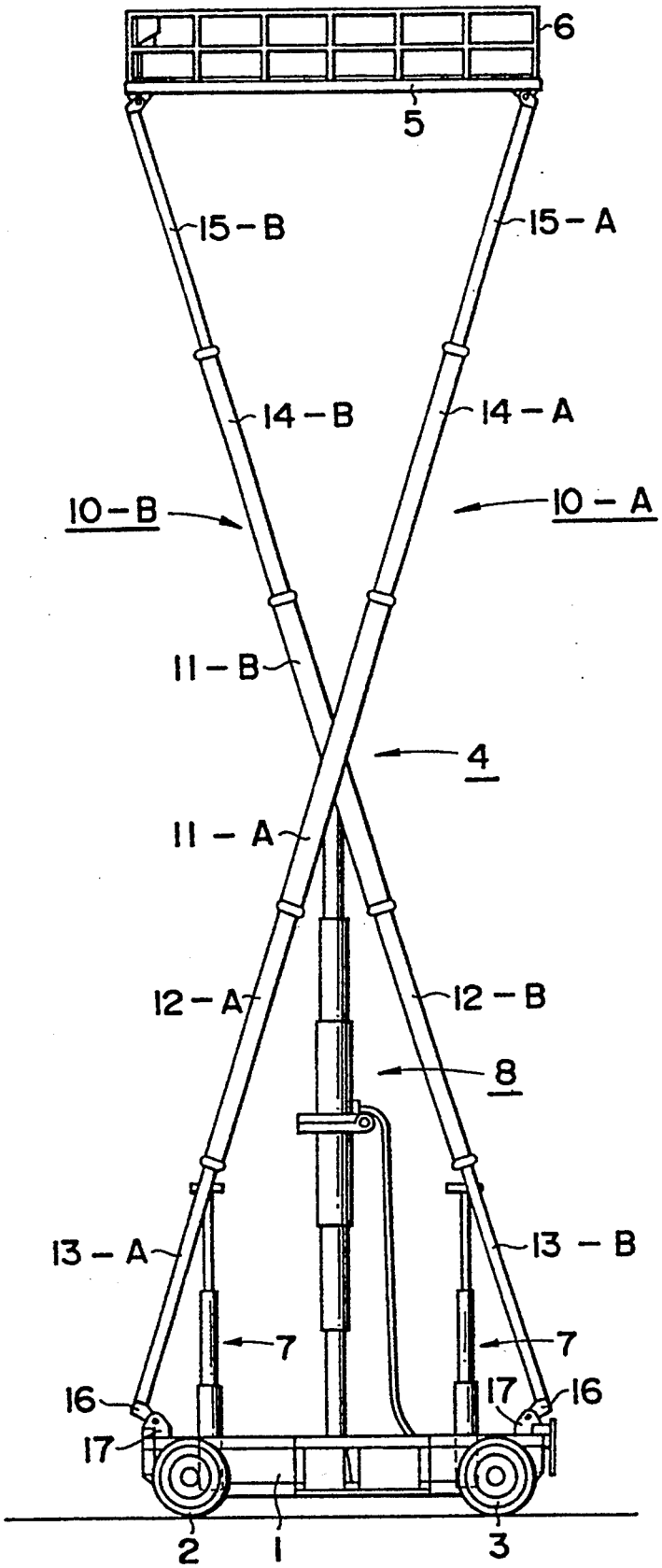
FIG. 3 is a side view of the lifting apparatus in FIG. 1 in which the platform is in its uppermost position.
Figure 4:
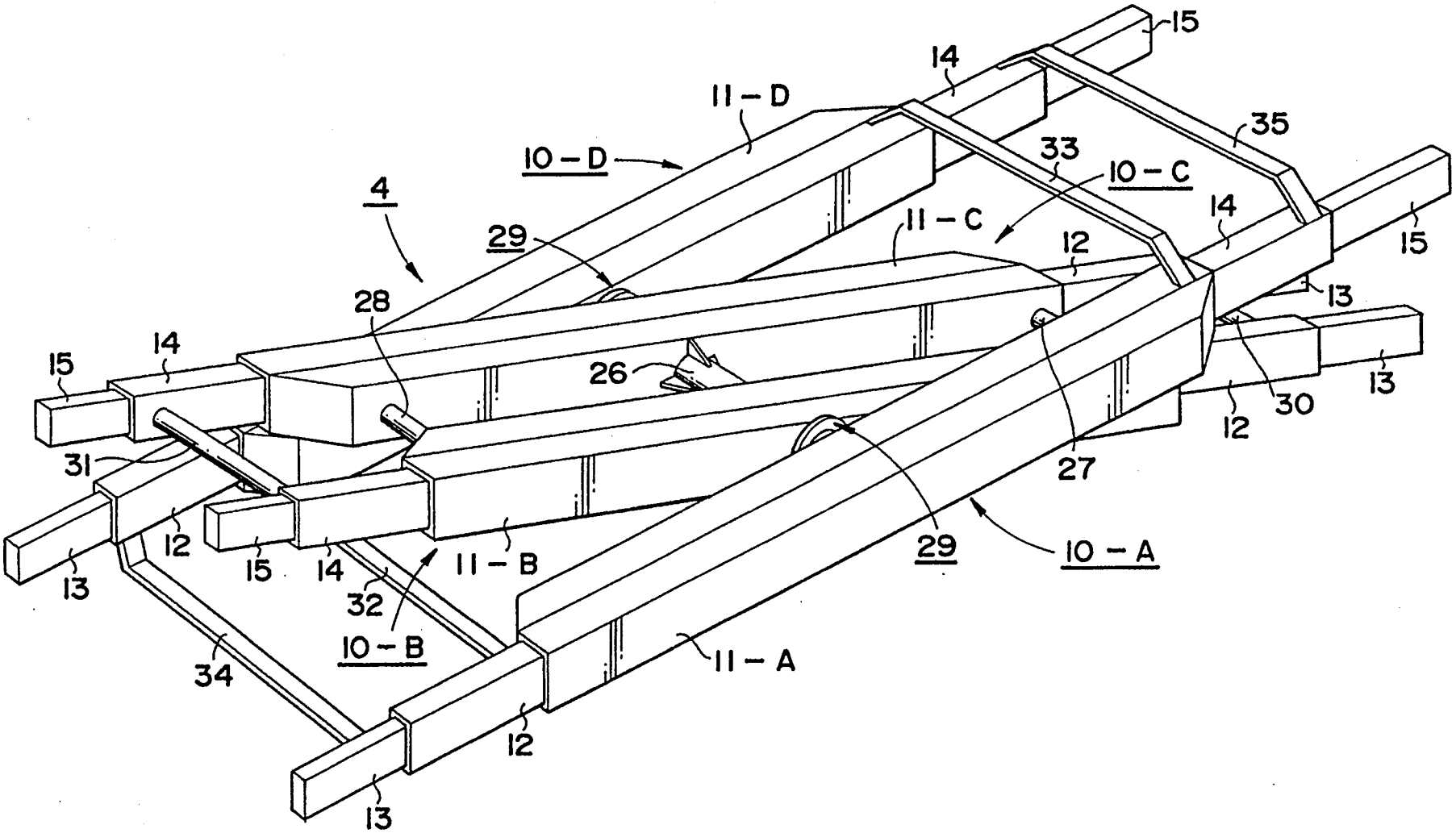
FIG. 4 is a schematic perspective view of a telescopic boom assembly.
Figure 5:
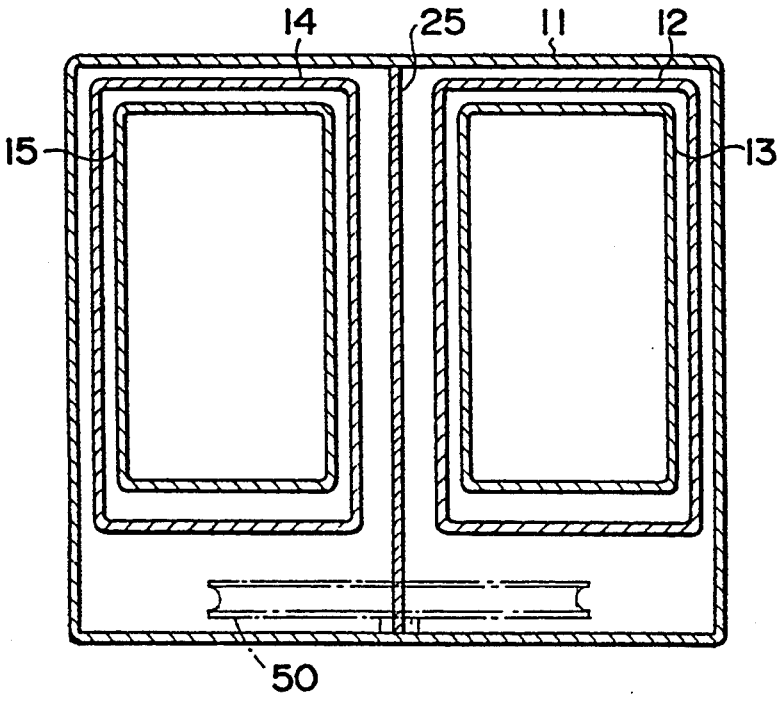
FIG. 5 is a cross sectional view showing the structure of the middle booms constituting the telescopic boom assembly.

A lifting apparatus according to a preferred embodiment of the present invention will be described with reference to FIGS. 1 to 3.

The lifting apparatus comprises a movable chassis 1 having front wheels 2 and rear wheels 3, a lifting mechanism 4 mounted on an upper surface of the chassis 1, and a platform 5 disposed over the lifting mechanism 4 and having a handrail 6 fixed thereon for preventing operators from falling therefrom. Fixed to the front and rear portions of the upper surface of the chassis 1 and disposed between the chassis 1 and lower booms 13 are kick mechanisms 7 for effecting an initial lifting of the platform 5. An operating mechanism 8 is connected between chassis 1 and the central portion of the lifting mechanism 4. The operating mechanism 8 is bent in a C-shape.

The lifting mechanism 4 comprises a pair of telescopic boom assemblies 10. Each telescopic boom assembly 10 comprises a middle boom 11, lower middle boom 12, lower boom 13, upper middle boom 14 and upper boom 15. One pair of middle booms 11 among the telescopic boom assemblies 10 are pivoted together in an X-shape at the inner central position thereof so that the middle booms 11 can pivot relative to one another.

The lower middle booms 12 are inserted in the middle booms 11 from the lower end openings of the middle booms 11 so that the lower middle booms 12 can telescopically move in the longitudinal direction of the middle booms 11, and the lower booms 13 are inserted into the lower middle booms 12 from the lower end openings thereof so that the lower booms 13 can telescopically move along the longitudinal direction thereof. There are fixed coupling members 16 at the lower ends of the lower booms 13 which are pivotally coupled to members 17 fixed to the chassis 1 at the front and rear portions thereof. The upper middle booms 14 are inserted into the middle booms 11 from upper end openings thereof so as to slide in the middle booms 11 in the longitudinal direction thereof. The upper booms 15 are inserted into the upper middle booms 14 from upper end openings thereof so as to telescopically move into the upper middle booms 14 in the longitudinal direction thereof. The upper booms 15 have coupling members 18 at the upper ends thereof which are pivotally coupled to members 19 which are fixed to the lower surface of the platform 5 at the front and rear portions thereof. The front-to-rear interval between the fixed members 17 is the same as the front-to-rear interval between the fixed members 19, whereby the platform 5 can rise upward while the chassis 1 and the platform 5 are maintained parallel with one another when the telescopic booms 10 turn to form the X-shape.

One end of the member of the operating mechanism 8 is swingably connected to an operating shaft 26, described later, which is connected between the middle booms 11, and the lower end of the other member of the operating mechanism 8 is swingably connected to the upper surface of the chassis.

FIGS. 4 to 8 show the internal structure of the lifting mechanism 4, i.e. the internal structure of the combinations of elements of the telescopic boom assembly 10 which will be described in detail later.

The middle booms 11, the lower middle booms 12, the lower booms 13, the upper middle booms 14 and the upper booms 15 respectively form the telescopic boom assembly 10 and are made from thin metal plate by folding thereof for forming long hollow tubes which are rectangular in cross section. The middle booms 11 are rectangular in cross section and have a partition plate 25 for dividing the interior into two interior spaces which extend along the longitudinal direction thereof. The lower middle boom 12 is slidably inserted in one of the inner spaces. The lower middle boom 12 is structured as a hollow tube which is substantially rectangular in cross section. The lower boom 13 is slidably inserted into the lower middle boom 12. The lower boom 13 is also structured as a hollow tube of substantially rectangular cross section. The upper middle boom 14 is slidably inserted into the other inner space of the middle boom 11. The upper middle boom 14 is a hollow tube of substantially rectangular cross section. The upper boom 15 is slidably inserted into the upper middle boom 14 and has a hollow tube of substantially rectangular cross section.

Figure 6:
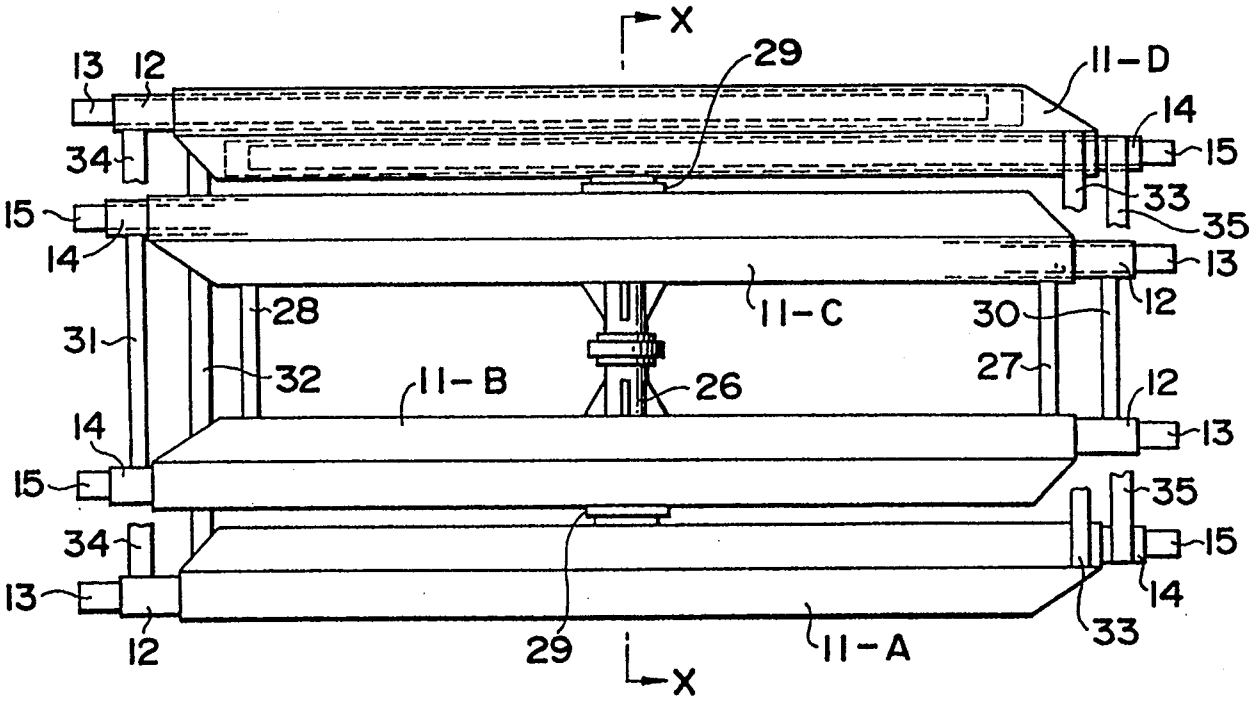
FIG. 6 is a plan view illustrating the arrangement of the middle booms in the lifting mechanism.

The telescopic boom assemblies 10 comprising the combination of the booms are disposed to be parallel with each other as shown in FIG. 6. In the same figure, four telescopic booms 10 are arranged in which the inner middle booms 11-B and 11-C are spaced from each other at a relatively large interval and the operating shaft 26 is intervened between the inner middle booms 11-B and 11-C at the central portions thereof. The operating shaft 26 contracts a cylinder rod of an upper side hydraulic cylinder of the operating mechanism 8. Reinforcing rods 27 and 28 are fixedly provided between the inner middle booms 11-B and 11-C at the upper and lower portions thereof. There is formed a lattice shaped structure by the middle booms 11-B, 11-C, the operating shaft 26, and the reinforcing rods 27 and 28.

There is provided a bearing mechanism 29 between the middle booms 11-A and 11-B at the central portion thereof whereby the middle booms 11-A and 11-B can be freely turned relative to one another. Similarly, the middle booms 11-C and 11-D are also coupled with each other to be freely turned.

There is provided a reinforcing rod 30 fixed between the pair of lower middle booms 12 adjacent the lower ends thereof, and a reinforcing rod 31 fixed between the pair of upper middle booms 14 adjacent the upper ends thereof. The lower middle booms 12 and the upper middle booms 14 are slidable in synchronization with each other. A reinforcing rod 32 is coupled between the middle booms 11-A and 11-D at the upper end portions thereof and extend under the middle booms 11-B and 11-C. A reinforcing rod 33 is fixed between the middle booms 11-A and 11-D at the upper end portions thereof and extends over the middle booms 11-B and 11-C. Hence, the middle booms 11-A and 11-D are assembled in the shape of the lattice intervening the reinforcing rods 32 and 33 at the both end portions thereof and the assembled body is formed as a rigid structure by the combination of the middle booms 11-A and 11-D and the reinforcing rods 32 and 33. A reinforcing rod 34 is fixed between the lower middle booms 12 telescopically extending from the middle booms 11-A and 11-D and extending under the middle booms 11-B and 11-C for reinforcing both the lower middle booms 12. A reinforcing rod 35 is fixed between the upper middle booms 14 telescopically extending from the middle booms 11-A and 11-D and extending under the middle booms 11-B and 11-C, and the upper middle booms 14 are reinforced by the reinforcing rod 35.

Figure 7:
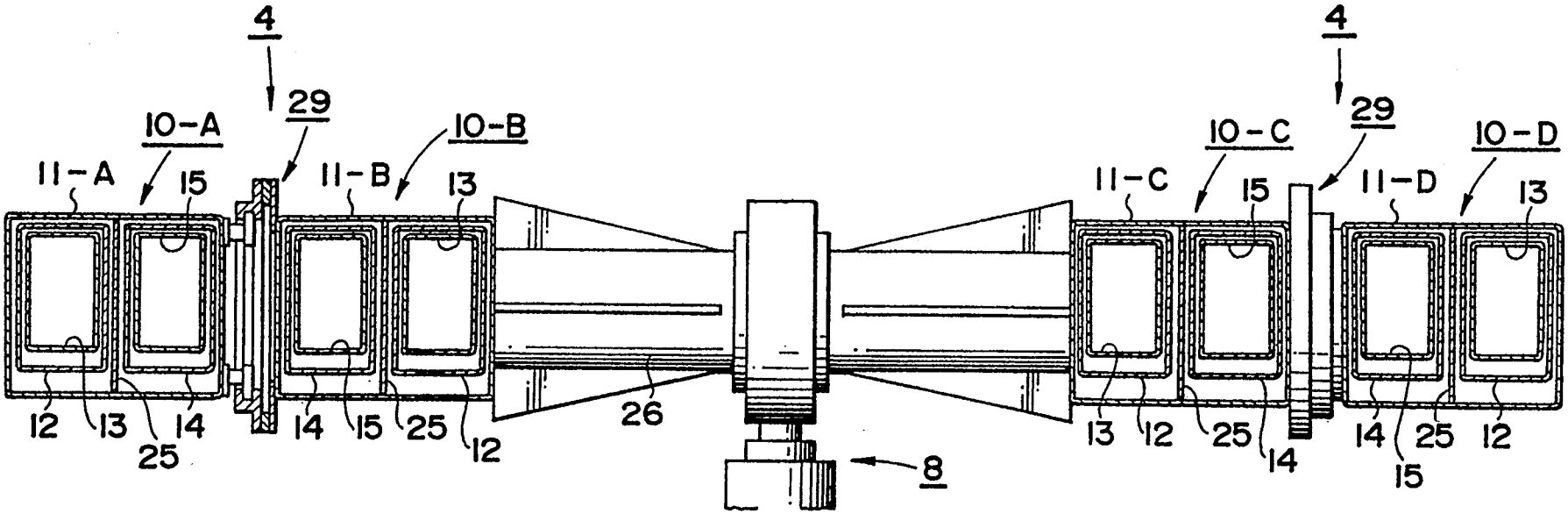
FIG. 7 is a cross-sectional view taken along the line 7—7 in FIG. 6.
Figure 8:
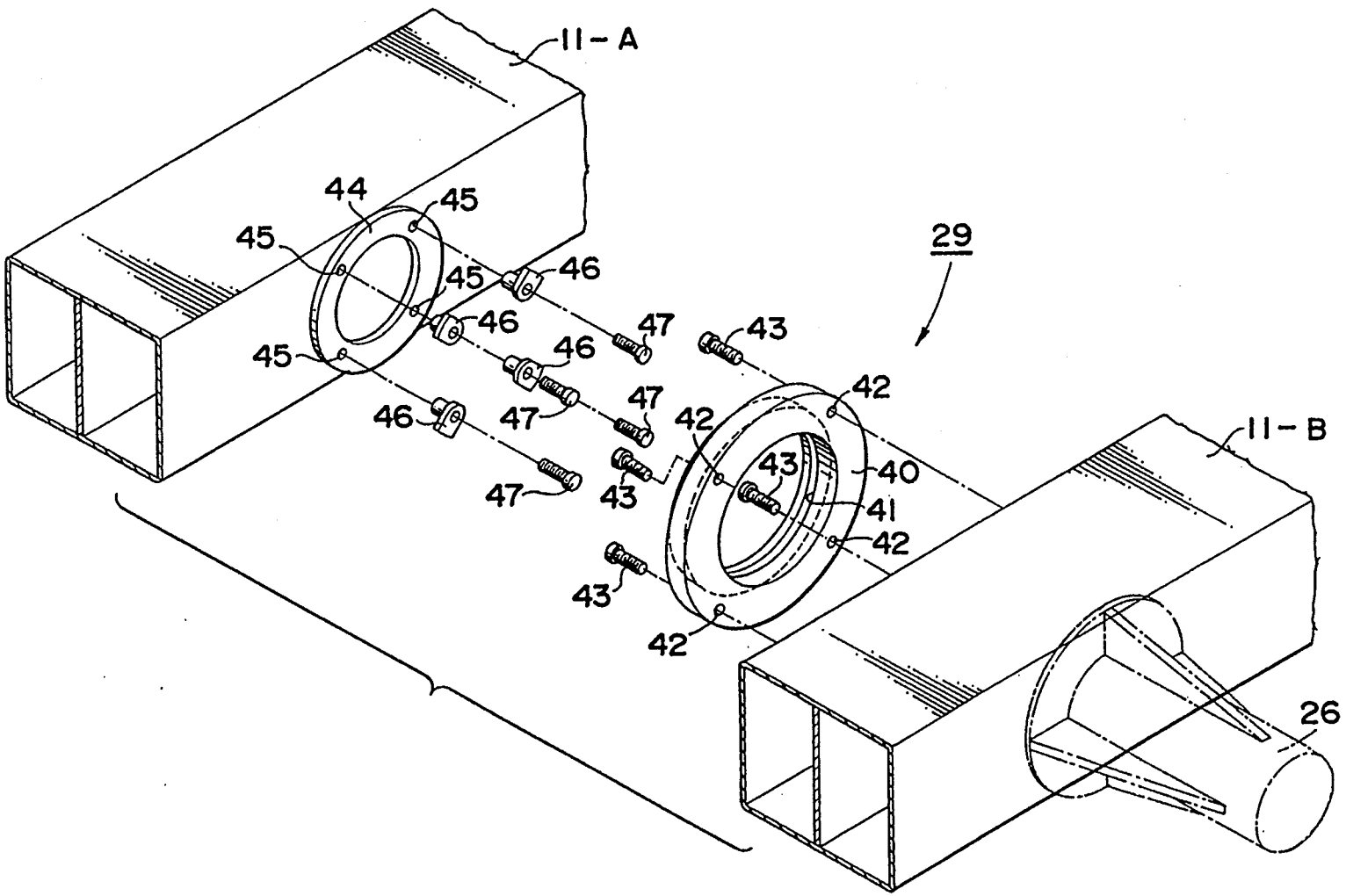
FIG. 8 is an exploded perspective view showing a structure of the bearing mechanism.

FIG. 7, being a cross-sectional view along the line 7—7 in FIG. 6, shows the relation between each of the middle booms 11-A, 11-B, 11-C, 11-D and the bearing mechanism 29. FIG. 8 is an exploded showing of the bearing mechanism 29.

The bearing mechanism 29 permits the two middle booms 11-A and 11-B to turn or pivot relative to one another and includes a ring shaped bearing washer 40 which is brought into contact with an outer side surface of the middle booms 11-A and 11-B. The bearing washer 40 has a circular guide groove 41 defined in an inner peripheral wall thereof and a plurality of screw holes 42 defined on the peripheral surface thereof. The bearing washer 40 is disposed coaxially with the operating shaft 26 at the central axis thereof and brought into contact with the side surface of the middle boom 11-B and screwed thereto by inserting the screws 43 into the screw holes 42.

There is fixed a ring-shaped washer plate 44 at the inner side surface of the middle boom 11-A at the central portion thereof, which seat plate 44 has a plurality of screw holes 45 defined at the peripheral surface thereof. A plurality of sliding retainer elements 46 are engaged in the guide groove 41 and have cylindrical hubs which are brought into alignment with the screw holes 45. The retainers 46 are fixed to the washer plate 44 by screws 47. Inasmuch as the retainers 46 are engaged in the peripheral guide groove 41 and are thereafter fixed to the bearing washer plate 40 by the screws 47, the washer plate 44 and the bearing washer plate 40 are assembled so as to be rotatable relative to one another.

Figure 9:
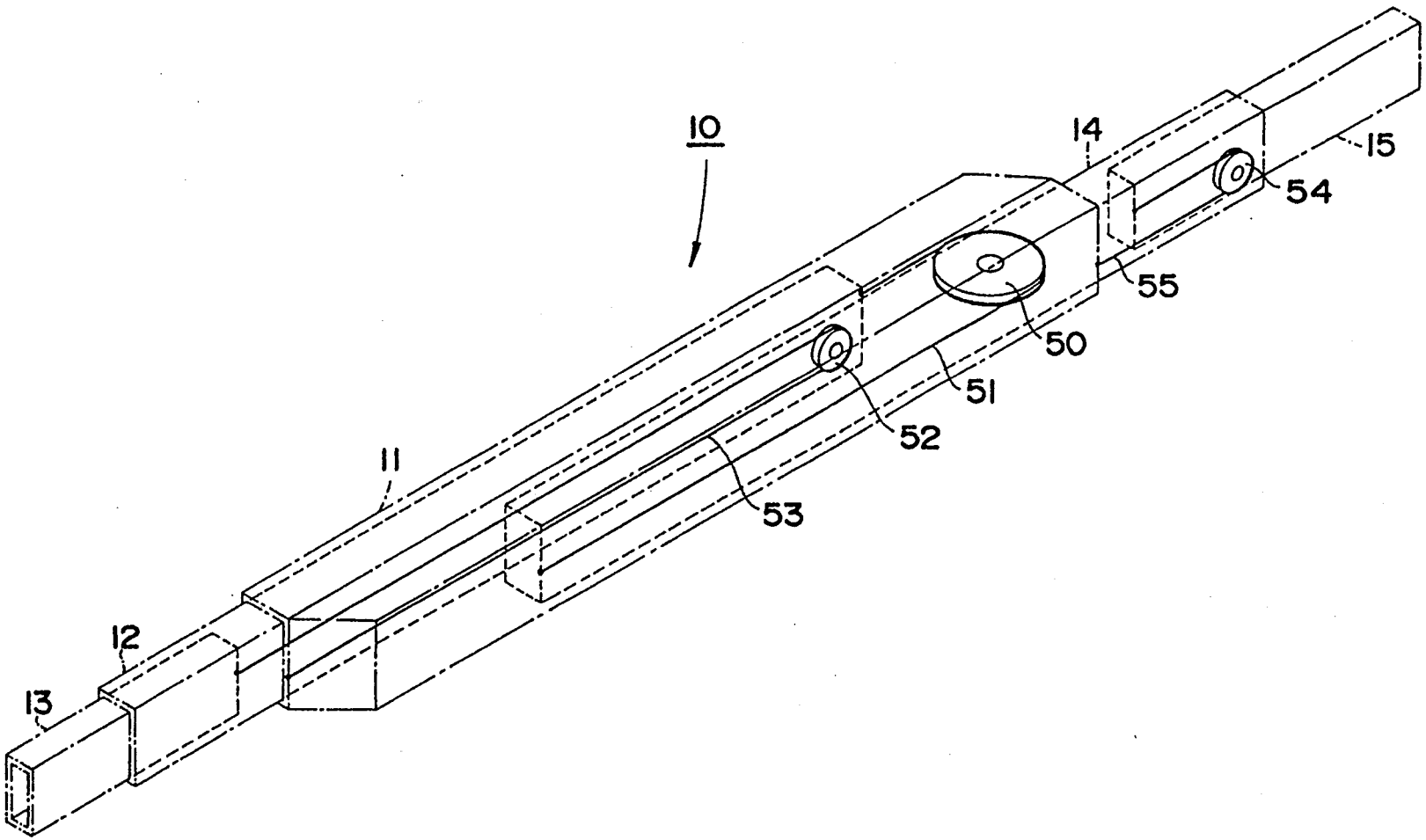
FIG. 9 is a view illustrating the synchronous mechanism in the telescopic boom assembly.

FIG. 9 shows a mechanism for synchronizing the lower middle boom 12, the lower boom 13, upper middle boom 14 and the upper boom 15 relative to the middle boom 11 in the telescopic boom assembly 10. According to the preferred embodiment of the present invention, the amount of telescopic movement of the lower middle boom 12 relative to the middle boom 11 must be the same as that of the upper middle boom 14 relative to the middle boom 11. In the same way, the amount of telescopic movement of the lower boom 13 relative to the lower middle boom 12 must be the same as that of the upper boom 15 relative to the upper middle boom 14. That is, it is indispensable that the platform 5 is raised vertically while the platform 5 is maintained parallel with the ground as shown in FIG. 3.

In FIG. 9, one of the four telescopic boom assemblies 10 is exemplified but the other three telescopic boom assemblies 10 have the same structures. FIG. 9 shows the positional relation between the lower boom 13 and the upper boom 15 but is slightly different from the actual mechanism.

There is provided a pulley 50 rotatably supported in the inside of the upper portion of the middle boom 11. A wire 51 is wound around the pulley 50 for synchronizing the lower middle boom 12 and the lower boom 13 with the upper middle boom 14 and the upper boom 15 relative to the middle boom 11 and has one end coupled to an upper end of the lower middle boom 12 and the other end coupled to a lower end of the upper middle boom 14. In such a mechanism, the lower middle boom 12 and the upper middle boom 14 are respectively moved by the same amount of telescopic movement relative to the middle boom 11. There is provided a pulley 52 rotatably supported at the upper end side portion of the lower middle boom 12. A wire 53 is wound around the pulley 52 and has one end coupled to an upper end of the lower boom 13 and the other end coupled to a lower end of the middle boom 11. There is provided a pulley 54 rotatably supported at the upper end side portion of the upper middle boom 14. A wire 55 is wound around the pulley 54 and has one end coupled to an upper end of the middle boom 11 an the other end coupled to a lower end of the upper boom 15.

Figure 10:
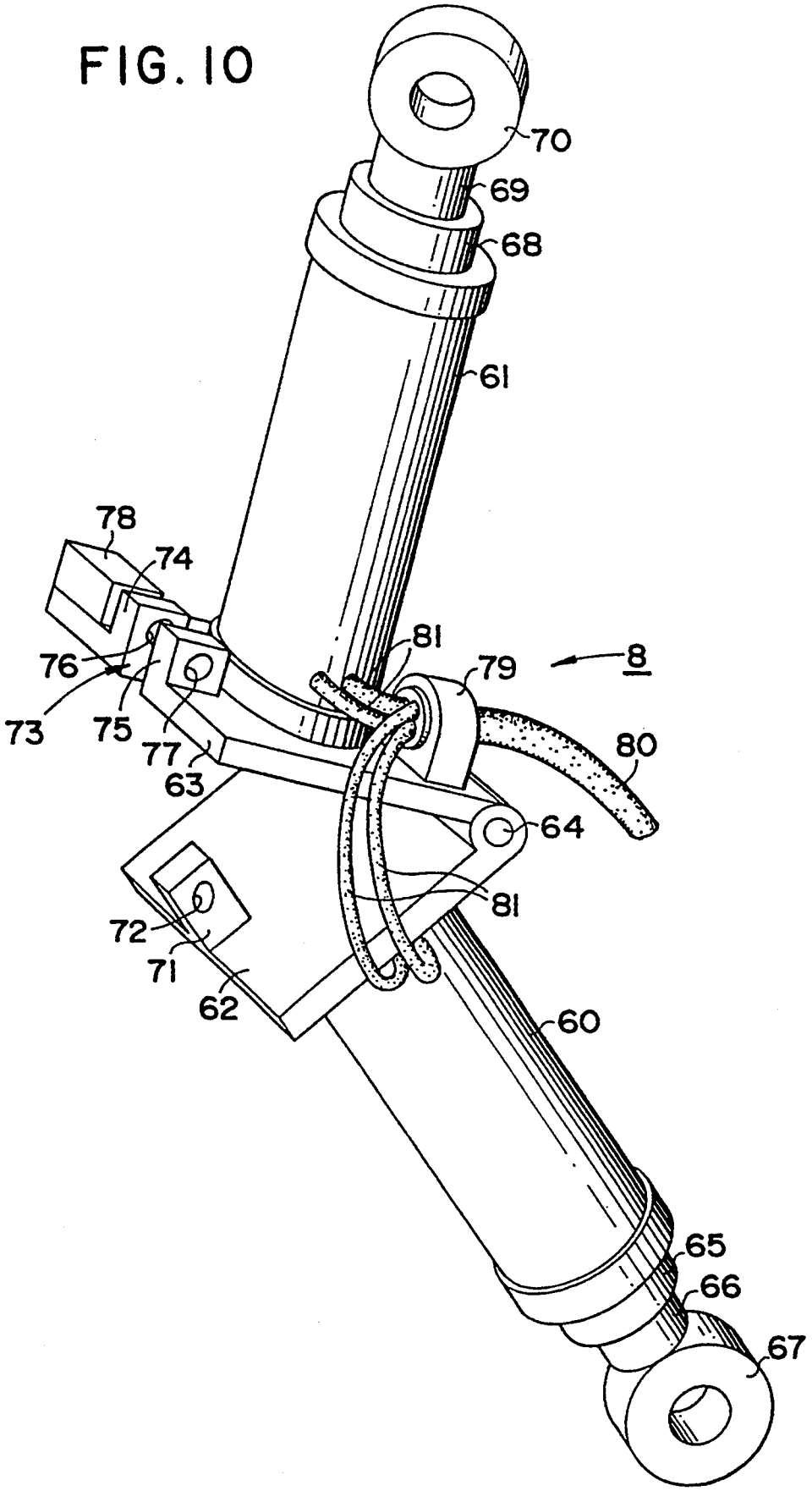
FIG. 10 is a view illustrating the structure of the operating mechanism.

FIG. 10 is a perspective view showing an arrangement of the operating mechanism 8. The operating mechanism 8 serves as a driving source for the lifting mechanism 4 and comprises two hydraulic cylinders 60 and 61.

The hydraulic cylinders 60 and 61 can be respectively extended and contracted in two stages and have the same structure as a known one. The hydraulic cylinders 60 and 61 are disposed such that the extending and contracting directions thereof are opposite to each other. A flat shaped swinging plate 62 is fixed to the base of the hydraulic cylinder 60 and a flat shaped swinging plate 63 is fixed to the base of the hydraulic cylinder 61. The swinging plates 62 and 63 are coupled by a coupling shaft 64 so that they can be opened and closed at one side thereof like a hinge. An engaging member 71 protrudes from the swinging plate 62 at the central open side thereof so as to be perpendicular to the flat surface thereof and has a pin hole 72 defined at the center thereof. An inserting groove 73 is defined on the swinging plate 63 at the central open side thereof. The engaging member 71 can move into or out from the inserting groove 73. Stopper members 74 and 75 protrude from the swinging plate 63 at the left and right of the inserting groove 73. Pin holes 76 and 77 are defined linearly on the stopper members 74 and 75 so as to be aligned with each other. A solenoid 78 is fixed to the upper surface of the swinging plate 63 at the portion adjacent to the stopper member 74 for moving a pin into or out from the pin holes 76 and 77 in response to an electric signal.

Cylinder rods 65 and 66 are inserted into the hydraulic cylinder 60 from the bottom end thereof so as to be extended therefrom and contracted thereinto in two stages and the cylinder rod 66 is coupled to a coupling ring 67 at the lower end thereof which is rotatably coupled to a coupling shaft provided on the center of the chassis 1. Cylinder rods 68 and 69 are inserted into the hydraulic cylinder 61 from the upper end thereof so as to be slidable thereinto in two stages and the cylinder rod 69 is coupled to a coupling ring 70 at the upper end thereof so as to be coupled to an outer periphery of the operating shaft 26. A cable stopper 70 is fixed to the upper surface of the swinging plate 63 and is also fixed to the upper end of a cable 80 having a large diameter which extends from the chassis 1. A plurality of hydraulic hoses 81 are inserted inside the cable 80 and other peripheral surfaces thereof are covered by a flexible synthetic rubber, etc. Each hydraulic hose 81 is exposed at the end surface of the cable stopper 79 and is connected to the hydraulic cylinders 60 and 61 at each tip end thereof.

Figure 11:
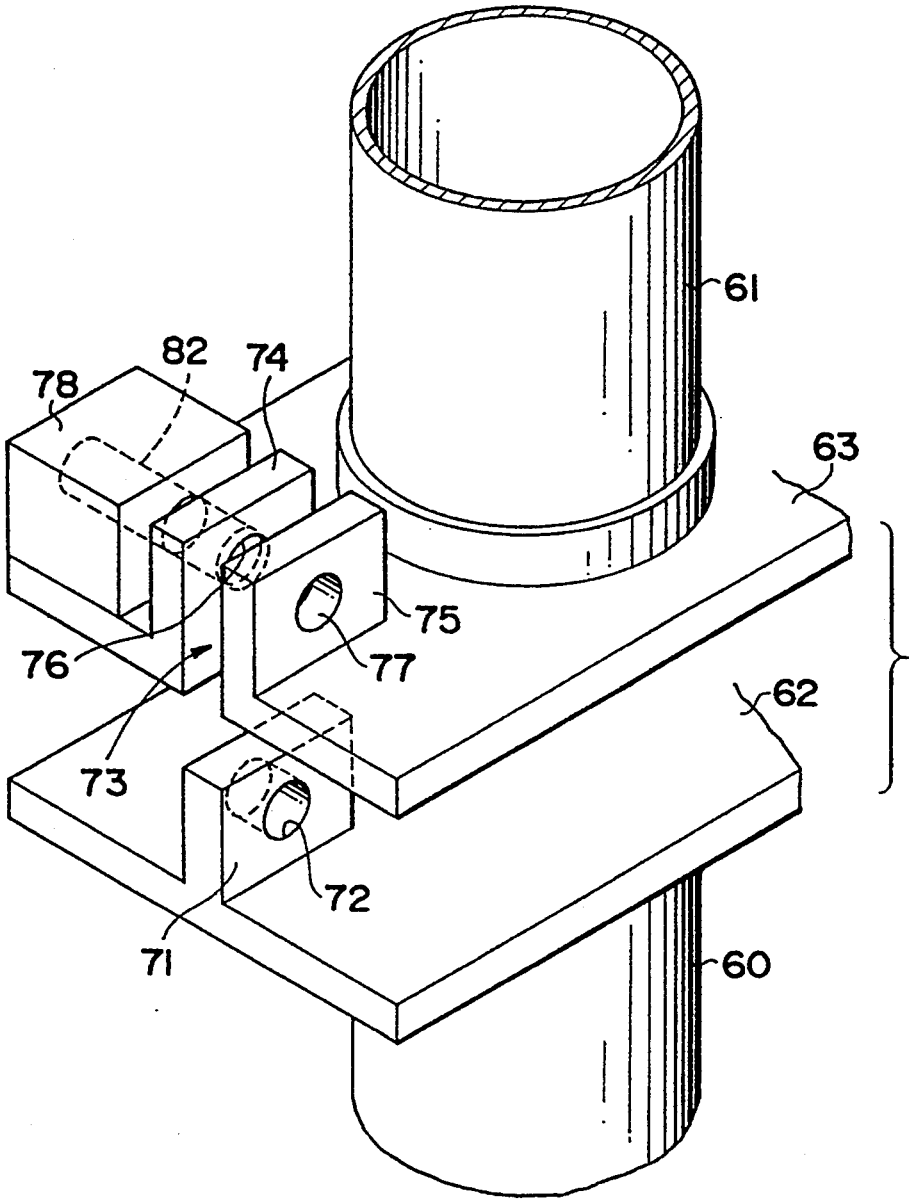
FIG. 11 is an enlarged perspective view of the coupling members of the operating mechanism in FIG. 10.

FIG. 11 shows in detail the structures of the swinging plates 62 and 63. A pin 82 is inserted inside the solenoid 78 and is movable horizontally in response to the electric signal. The pin holes 76 and 77 are provided in coaxial direction with the axial moving direction of the stopper pin 82. The engaging member 71 is inserted into an inner space of the inserting groove 73 when the swinging plate 62 is turned about the coupling shaft 64 and the upper surface of the swinging plate 62 approaches to bring into contact with the lower surface of the swing plate 63. Upon completion of the insertion of the engaging member 71 into the inner space of the inserting groove 73, the central axis of the pin hole 72 is aligned with the central axes of the pin holes 76 and 77.

Figure 12:
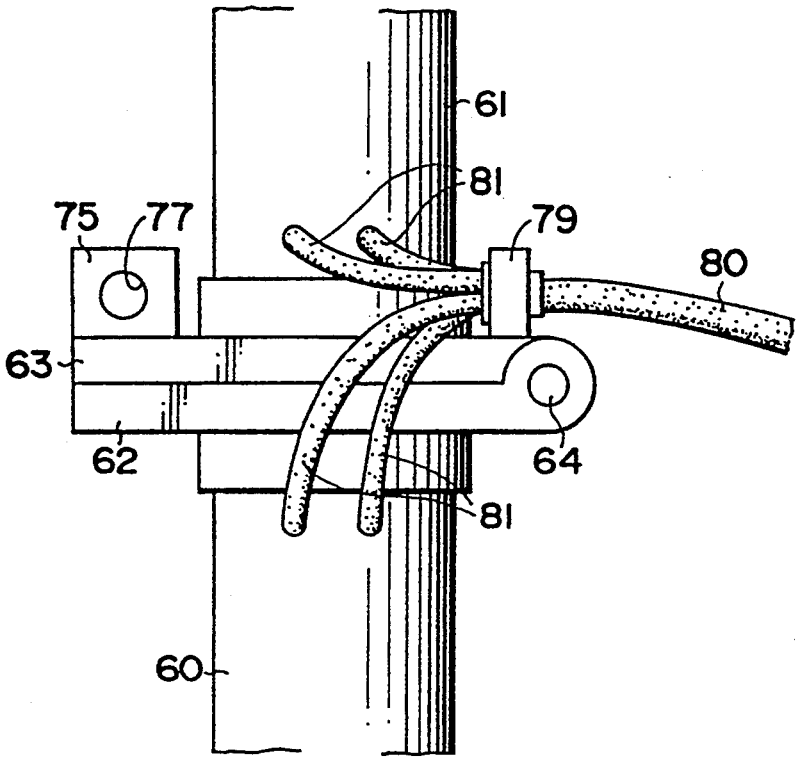
FIG. 12 is an enlarged view of the coupling members in FIG. 11 in which the coupling members are coupled with each other.

FIG. 12 shows the state where the swinging plates 62 and 63 are brought into contact with each other when they are turned about the coupling shaft 64.

An operation of the preferred embodiment will be described hereinafter.

Figure 13:
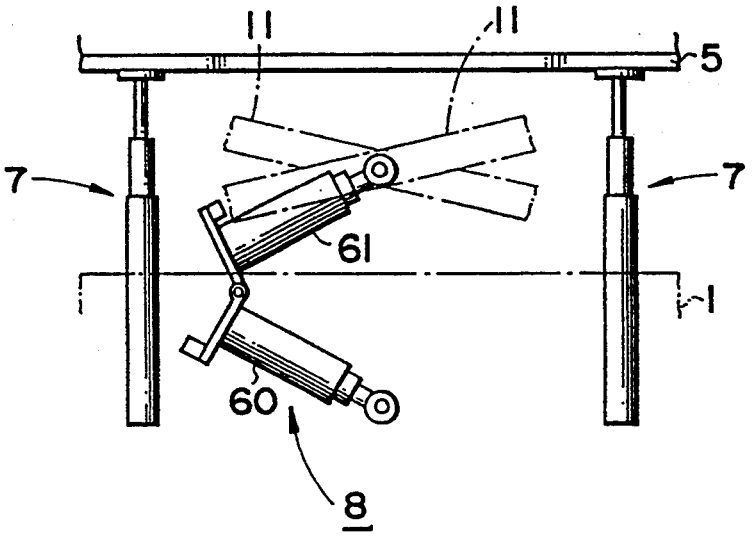
FIG. 13 is a view illustrating the platform slightly lifted by the kick mechanism.

When the engine (not shown) mounted on the chassis 1 is actuated to drive the hydraulic pump (not shown) serving as the hydraulic pressure source to generate hydraulic pressure, oil under pressure sucked by the hydraulic pump is first supplied to the hydraulic cylinders of the kick mechanisms 7. Then, the kick mechanisms 7 extend to raise the platform 5. While the platform 5 is raised, each boom of each telescopic boom assembly 10 operates so as to be pulled out from the upper and lower ends of the middle booms 11 so that each middle boom 11-A, 11-B, 11-C and 11-D turns about the bearing mechanism 29 in opposite directions relative to one another and the telescopic boom assembly 10 is formed to be slightly in an X-shape as viewed from the side as shown in FIG. 13.

When the telescopic boom assembly 10 is formed to be slightly in an X-shape when it is raised by the operation of the kick mechanisms 7, the lower middle boom 12, the lower boom 13, the upper middle boom 14 and the upper boom 15 are pulled out from both end openings of the middle booms 11 since the lower end of the lower boom 13 is coupled to the chassis 1 by way of the coupling member 16 and the fixed member 17 and the upper end of the upper boom 15 is coupled to the platform 5 by way of the coupling member 18 and the fixed member 19. That is, the lower middle booms 12 are pulled out from the middle booms 11 and the lower booms 13 are pulled out from the lower middle booms 12 while the upper middle booms 14 are pulled out from the middle booms 11 and the upper booms 15 are pulled out from the upper middle booms 14, and hence the movements of the lower middle boom 12, the lower boom 13, the upper middle boom 14 and the upper boom 15 are synchronous with one another. These moving operations are explained more in detail with reference to FIG. 9.

When the middle boom 11 is raised by the kick mechanisms 7, the lower boom 13 is pulled out from the lower end of the lower middle boom 12 since the lower boom 13 is coupled to the chassis 1 and hence it is not changed in its position. At the same time, since the wire 53 is connected to the lower boom 13, the wire 53 operates to pull down the pulley 52. Accordingly, the lower middle boom 12 supporting the pulley 52 is pulled out from the lower end of the middle boom 11. Successively, when the lower middle boom 12 is pulled out from the middle boom 11, the wire 51 connected to the lower middle boom 12 is pulled down and reversed by the pulley 50 and operates to push up the upper middle boom 14 connected to the other end of the wire 51 from the upper opening of the middle boom 11. When the upper middle boom 14 is raised from the middle boom 11, the pulley 54 supported by the upper middle boom 14 is also raised so as to operate to pull up the wire 55 wound around the pulley 54. Since one end of the wire 55 is connected to the middle boom 11, the upper boom 15 is stretched when the pulley 54 is pulled up so that the upper boom 15 is pulled out from the upper opening of the upper middle boom 14.

The distance of movement of the middle boom 11 relative to the lower middle boom 12 is set to be the same length as that of the lower boom 13 relative to the lower middle boom 12 when the former is pulled out from the latter. Hence, the lower middle boom 12 and the lower boom 13 are respectively pulled out for the same length relative to the middle boom 11. When the lower middle boom 12 is pulled out from the middle boom 11, the wire 51 is pulled out downward which is delivered to the upper middle boom 14 through the pulley 50 and the upper middle boom 14 is pulled out from the upper open end of the middle boom 11. The amount of movement of the upper middle boom 14 when it is pulled out from the middle boom 11 is the same as that of the lower middle boom 12 when it is pulled out from the middle boom 11. When the upper middle boom 14 is further pulled out from the middle boom 11, the pulley 54 supported by the upper middle boom 14 pulls the wire 55. Since one end of the wire 55 is fixed to the middle boom 11, the wire 55 is still positioned in the same position at one end thereof but the upper boom 15 to which the other end of the wire fixed is pulled out from the upper middle boom 14. The amount of movement of the upper boom 15 when it is pulled out from the upper middle boom 14 is the same as that of the upper middle boom 14 when it is pulled out from the middle boom 11.

With such an interlocking operation of the wires 51, 53 and 55, the lower middle boom 12, the lower boom 13, the upper middle boom 14 and the upper boom 15 are pulled out respectively relative to the middle boom 11, the amount of movement of the lower middle boom 12 when it is pulled out from the middle boom 11 is the same as that of the upper middle boom 14 when it is pulled out from the middle boom 11, the amount of movement of the lower boom 13 when it is pulled out from the lower middle boom 12 is the same as that of the upper boom 15 when it is pulled out from the upper middle boom 14, and hence each of the booms is synchronized for the same amount of movement.

Although the interlocking operation is exemplified for the synchronous operation of one of the telescopic boom assemblies 10 as shown in FIG. 9, the same synchronous operation is effected for the other telescopic boom assemblies 10. The amount of movements of all the booms of each of the telescopic boom assemblies 10 forming the X-shape is the same, whereby the lifting mechanism 4 can extend to a large amount while the X-shape thereof is maintained but moved to keep the X-shapes analogous with one another. Accordingly, the platform 5 is raised vertically upward relative to the chassis 1 while it is kept horizontal relative to the ground.

In the telescopic movement of the pair of telescopic boom assemblies 10, two middle booms 11-A, 11-B and 11-C, 11-D are rotated relative to each other by the bearing mechanism 29. In the bearing mechanism 29, since the sliding retainers 46 are engaged in the guide groove 41 of the bearing washer plate 40, the retainers slide and move along the inner periphery of the guide groove 41. As a result, the middle booms 11-A and 11-B can be rotated relatively in opposite directions without varying the left and right intervals thereof, whereby both the middle booms 11-A and 11-B can be maintained in the X-shape.

Figure 14:
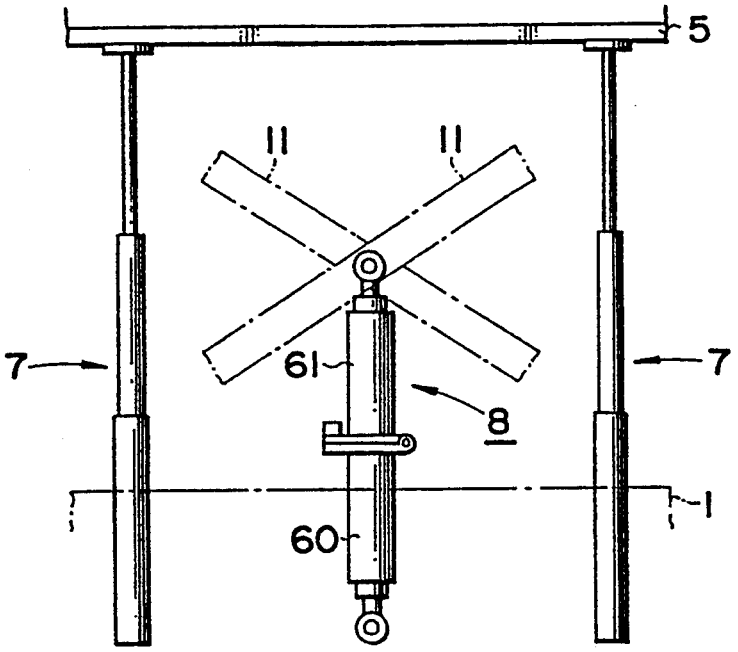
FIG. 14 is a view to illustrate how the operating mechanism is linearly assembled from its folded state.

When such operations are repeated, the platform 5 is further raised from the state as shown in FIG. 13, and is finally raised at the height as shown in FIG. 14. In such a manner, if the kick mechanisms 7 are extended entirely, in the operating mechanism 8 which has so far been bent in the C-shape, the swinging plates 62 and 63 are turned about the coupling shaft 64 so as to approach relative to each other, and finally the upper surface of the swinging plate 62 contacts the lower surface of the swinging plate 63. If both the swinging plates 62 and 63 contact each other, the hydraulic cylinders 60 and 61 fixed to the swinging plates 62 and 63 rise upright like a straight column.

When the swinging plates 62 and 63 fixed to the bases of the hydraulic cylinders 60 and 61 are brought into contact with each other as shown in FIG. 11, the engaging member 71 of the swinging plate 62 is inserted into the inserting groove 73 of the swinging plate 63 and the pin holes 72, 76 and 77 are positioned so as to be aligned with one another in the axial lines thereof. At this state, when the electric signal is supplied to the solenoid 78, the stopper pin 82 moves horizontally and is inserted into the pin holes 76, 72 and 77, whereby the swinging plates 62 and 63 are fixed by this stopper pin not to be moved from each other. This state is the one where the operating mechanism 8 rises upright. When the oil under pressure is supplied to the hydraulic cylinders 60 and 61 from the hydraulic pump through the hydraulic hose 81, the cylinder rods 65 and 66 are extended from the lower end of the hydraulic cylinder 60 and the cylinder rods 68 and 69 are extended from the upper end of the hydraulic cylinder 61.

Figure 15:
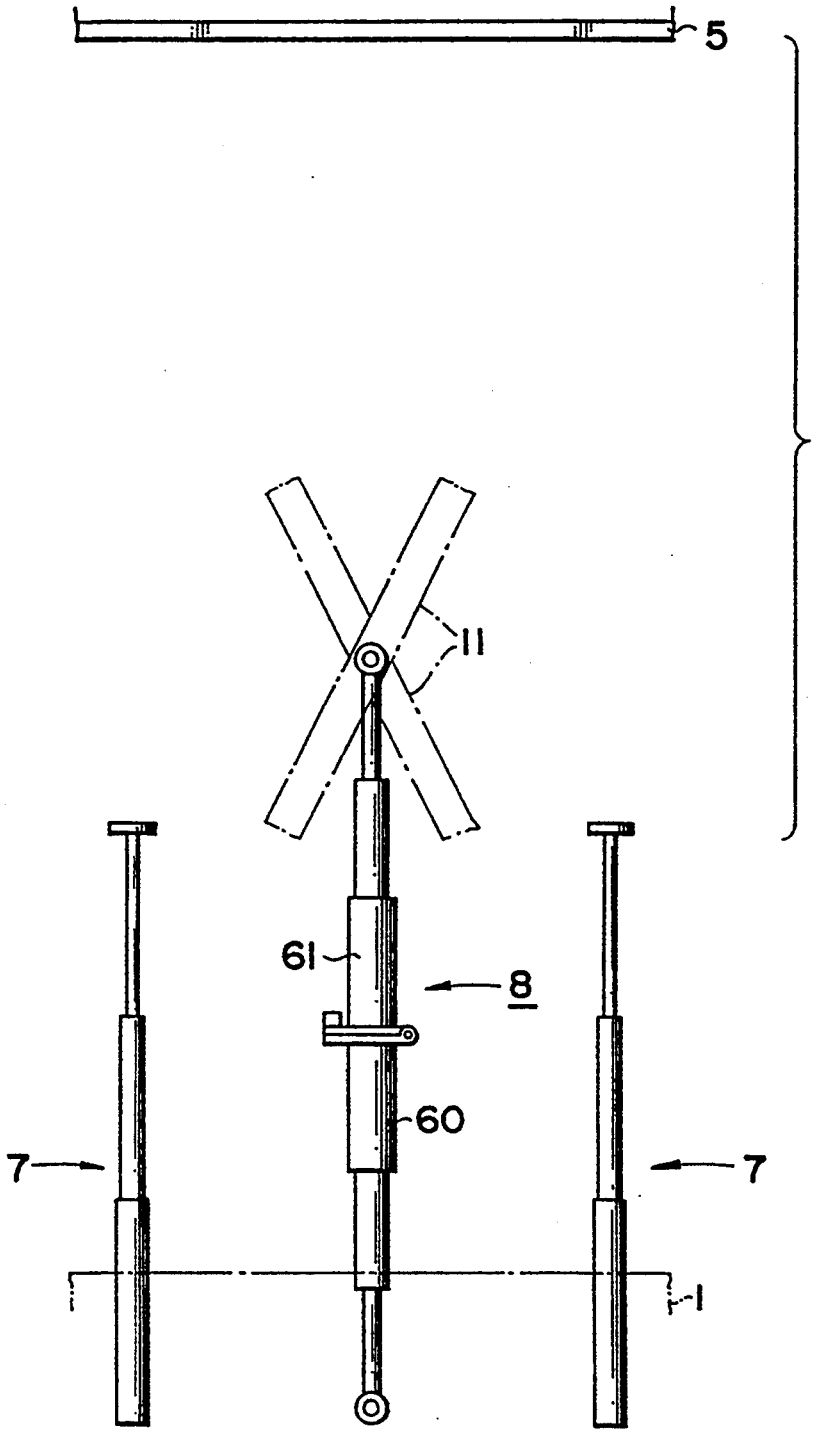
FIG. 15 is a view showing the operating mechanism extended at its maximum length and the platform raised to its uppermost position.

When each cylinder rod 65, 66, 68 and 69 is extended from the hydraulic cylinders 60 and 61, the distance between the coupling rings 67 and 70 coupled to both ends of the cylinder rods 66 and 69 is increased so as to raise the operating shaft 26 upward. Consequently, the middle booms 11-B, 11-C, 11-A and 11-D are successively raised upward. Even in the upward rising operations, the lower middle boom 12, the lower boom 13, the upper middle boom 14 and the upper boom 15 are pulled out from the both ends of the middle boom 11 synchronously with one another so that the platform is further raised. If the supply of the oil under pressure to the hydraulic cylinders 60 and 61 is stopped after the platform 5 is raised at a predetermined position, the platform can be maintained at the predetermined so that the operation on the elevated spot can be carried out. FIG. 15 shows the state where the hydraulic cylinders 60 and 61 are entirely extended so that the platform is raised at its maximum height.

As described above, the platform 5 is raised to the higher position by the two-staged extension operations of the kick mechanisms 7 and the operating mechanism 8. The kick mechanisms 7 effect the initial lifting of the platform 5 as the hydraulic cylinders thereof are moved up to support the heavy materials on the platform 5. Successively, the pair of hydraulic cylinders 60 and 61 which have been accommodated in the C-shape rise upright to thereby support and further raise the platform 5, and hence the heavy materials on the platform 5 can be supported by the mechanism 8.

When the platform 5 is lowered after it is raised at the highest position as shown in FIG. 15, the direction of supply of the oil under pressure to the hydraulic cylinders 60 and 61 is reversed so as to pull each cylinder rod 65, 66, 68 and 69 inside the hydraulic cylinders 60 and 61. At the state where each cylinder rod 65, 66, 68 and 69 are accommodated in the hydraulic cylinders 60 and 61 and the lower surface of the platform 5 contact the upper end of the kick mechanisms 7 as shown in FIG. 14, the supply of the electric signal to the solenoid 78 is stopped so as to return the stopper pin 82 to the side of the solenoid 78. Then, the connection of the swinging plates 62 and 63 by the stopper pin 82 in the pin holes 76, 72 and 77 are released, namely, the swinging plate 62 is disconnected from the swinging plate 63 so that the operating mechanism 8 can be returned to the folded C-shape as viewed from the side surface of the lifting mechanism. Successively, when the amount of the oil under pressure to be supplied to the kick mechanisms 7 is reduced, the platform 5 is further lowered and the swinging plates 62 and 63 are turned about the coupling shaft 64 so that the operating mechanism 8 is folded from the upper and lower directions as shown in FIG.

13. With successive repetitions of these operations, the platform 5 is lowered to the position close to the upper surface of the chassis 1 and stopped at the state as shown in FIGS. 1 and 2.

As the invention has been structured as mentioned above, the platform is first raised by a kick mechanism and then further raised when the operating mechanism, which is initially folded in the substantially C-shape, is assembled straight to thereby extend upward. Accordingly, the load of the platform is always supported by hydraulic cylinders which are always vertically directed, and the operating mechanism can support the heavy materials on the platform. Furthermore, the hydraulic cylinders are switched to two stages so as to move the platform vertically, and the platform can be raised at the highest position.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A lifting apparatus comprising at least one set of paired stretchable boom assemblies each comprising a pair of middle booms which are joined in a generally X-shape for relatively pivoting about the central portions thereof, at least one set of lower booms movably telescopically inserted into the middle booms along the longitudinal direction thereof from lower end openings of the middle booms and pivotally connected to a chassis at lower ends thereof with leaving intervals therebetween, and at least one set of upper booms telescopically inserted into the middle booms along the longitudinal direction thereof from upper end openings of the middle booms and pivotally connected at upper ends thereof to a platform with leaving intervals therebetween, wherein said lower booms and upper booms are respectively slidable synchronous with one another relative to the middle booms to thereby lift or lower a platform while keeping said platform horizontal relative to the ground when the middle booms are moved vertically, characterized in that said lifting apparatus further comprises an operating mechanism which is disposed between the chassis and the middle booms and which is folded and is assembled straight vertically for lifting the middle booms, said operating mechanism comprising a pair of hydraulic cylinders coupled to each other at each one end thereof, one hydraulic cylinder being connected to said chassis at a lower end thereof and the other hydraulic cylinder being connected to the central portion of said middle boom, and wherein said pair of hydraulic cylinders are accommodated between said middle booms and said chassis while they are bent in a substantially C-shape when said platform is lowered and they are linearly assembled when said platform is raised.

2. A lifting apparatus according to claim 1, wherein said lifting mechanism comprises two sets of paired telescopic boom assemblies.

3. A lifting apparatus according to claim 1, wherein said operating mechanism further comprises a fixed mechanism for stopping the turning of said pair of hydraulic cylinders when said hydraulic cylinders are linearly assembled.

4. A lifting apparatus according to claim 1, further comprising kick mechanisms which is mounted on said chassis for effecting an initial lifting of the platform.

5. A lifting apparatus according to claim 1, wherein said at least one set of upper and lower booms which are respectively pulled out from or pulled in both ends of said pair of X-shaped middle booms are connected with one another by a wire which is wound around a pulley supported by said middle booms for synchronizing the amount of stretching movement thereof from said middle booms.

6. A lifting apparatus according to claim 1, wherein said at least one set of upper and lower booms which are respectively pulled out from or pulled in both ends of said pair of X-shaped middle booms in which a lower boom and a lower middle boom are extended from or contracted in said middle boom from the lower opening of said middle boom and an upper boom and an upper middle boom are extended from and contracted in said middle boom, and wherein said lower boom and the upper boom are connected to each other by a wire, said wire is wound around a pulley supported by said middle boom, said lower boom and said middle boom are connected to each other by a lower side wire, said lower side wire is wound around a pulley supported by a lower middle boom, said upper boom and said middle boom are connected to each other by an upper side wire, said upper side wire is wound around a pulley supported by said upper middle boom, wherein the amount of telescopic movement of said lower and upper booms relative to said middle boom is synchronized by said wire, the amount of telescopic movement of said lower middle boom and said lower boom are synchronous with each other by said lower side wire, and the amount of telescopic movement of said upper middle boom and said upper boom are synchronous with each other by said upper side wire.

7. A lifting apparatus comprising:

a movable chassis;

a platform disposed over the chassis;

a lifting mechanism cooperating between the chassis and the platform for effecting vertical movement of the platform between lowered and raised positions while maintaining the platform substantially horizontal, said lifting mechanism including at least one set of paired stretchable boom assemblies disposed and connected between the chassis and the platform for raising and lowering the platform;

the one set of paired stretchable boom assemblies comprising a pair of middle booms which are joined in a generally X-shape for relative pivoting between the middle booms substantially about center portions thereof, lower booms movably telescopically inserted into the middle booms along the longitudinal direction thereof and connected to the chassis at the lower ends thereof, and upper booms movably telescopically inserted into the middle booms along the longitudinal direction thereof and connected to the platform at the upper ends thereof;

a kick mechanism mounted on the chassis and cooperating with at least one of the middle booms for effecting initial lifting of the platform from the lowered positioned into an intermediate position; and an operating mechanism cooperating between the chassis and the middle booms for effecting vertical lifting of the platform upwardly from said intermediate position to said raised position, said operating mechanism being maintained in a partially folded inoperative condition when said platform is located below said intermediate position, said operating mechanism extending generally vertically upwardly between said chassis and said middle booms when said platform is in said intermediate position to effect a vertically upwardly directed force on said lifting mechanism, and said operating mechanism including a pair of fluid pressure cylinders having adjacent ends hingedly coupled together so that the pair of pressure cylinders can be moved from the folded condition wherein the pressure cylinders are disposed generally side-by-side into a substantially vertically aligned position, one said pressure cylinder having the other end thereof connected to the chassis, and the other said pressure cylinder having the other end thereof connected to the central portion of the middle booms substantially at the point of pivoting, said pair of fluid pressure cylinders being moved into a position of vertical alignment when the platform reaches the intermediate position.

8. A lifting apparatus according to claim 7, wherein the kick mechanism includes a pressure cylinder which is vertically extendible and cooperates between the chassis and one of the middle booms for effecting lifting of the platform into the intermediate position, said kick mechanism being ineffective for imposing a vertical lifting force on the middle boom after the platform is raised above said intermediate position.

9. A lifting apparatus according to claim 8, wherein there are a pair of said kick mechanism which are spaced apart on generally opposite sides of said operating mechanism, each said kick mechanism being positioned for engagement with a different one of said middle booms.

10. A lifting apparatus according to claim 9, wherein the upper boom includes a middle upper boom part which is slidably telescopically supported in the middle boom and an upper boom part which has an upper end thereof connected to the platform and is slidably telescopically supported on the middle upper boom part; and wherein the lower boom has a middle lower boom part which is telescopically supported on the middle boom and a lower boom part which has a lower end connected to the chassis and which is slidably telescopically supported on the lower middle boom part; and a synchronizing mechanism cooperating between the middle booms and said boom parts for controlling and causing synchronized extension and contraction of the upper and lower boom parts relative to the middle booms.

11. A lifting apparatus according to claim 7, wherein the upper boom includes a middle upper boom part which is slidably telescopically supported in the middle boom and an upper boom part which has an upper end thereof connected to the platform and is slidably telescopically supported on the middle upper boom part; and wherein the lower boom has a middle lower boom part which is telescopically supported on the middle boom and a lower boom part which has a lower end connected to the chassis and which is slidably telescopically supported on the lower middle boom part; and a synchronizing mechanism cooperating between the middle booms and said boom parts for controlling and causing synchronized extension and contraction of the upper and lower boom parts relative to the middle booms.

* * * * *